US010006474B2

(12) United States Patent
Oshima et al.

(10) Patent No.: US 10,006,474 B2
(45) Date of Patent: Jun. 26, 2018

(54) FLOW PASSAGE UNIT AND SWITCHING VALVE

(71) Applicant: SMC CORPORATION, Chiyoda-ku (JP)

(72) Inventors: Masayuki Oshima, Tsukuba (JP); Katsushi Hatano, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 101 days.

(21) Appl. No.: 15/132,893

(22) Filed: Apr. 19, 2016

(65) Prior Publication Data

US 2016/0327069 A1 Nov. 10, 2016

(30) Foreign Application Priority Data

May 8, 2015 (JP) ..... 2015-095523

(51) Int. Cl.
*F15B 13/04* (2006.01)
*F15B 13/042* (2006.01)
*F15B 11/064* (2006.01)

(52) U.S. Cl.
CPC ..... *F15B 13/042* (2013.01); *F15B 11/064* (2013.01); *F15B 13/0417* (2013.01); *Y10T 137/2544* (2015.04)

(58) Field of Classification Search
CPC .. F15B 11/064; F15B 13/0417; F15B 13/042; Y10T 137/2544
See application file for complete search history.

(56) References Cited

U.S. PATENT DOCUMENTS 5,415,199 A * 5/1995 Claudinon ..... F15B 11/163 137/596
6,532,989 B1 * 3/2003 Kauss ..... F15B 13/0407 137/514.3
6,581,639 B2 * 6/2003 Fiala ..... F15B 11/028 137/596.2
2013/0019958 A1 1/2013 Miyazoe et al.

FOREIGN PATENT DOCUMENTS

JP 2013-24345 2/2013

* cited by examiner

*Primary Examiner* — Kevin Murphy
(74) *Attorney, Agent, or Firm* — Oblon, McClelland, Maier & Neustadt, L.L.P.

(57) ABSTRACT

A flow passage unit of a switching valve includes an energy-saving valve mechanism provided in a second flow passage of a flow passage body. The energy-saving valve mechanism has a movable body including a piston section and a valve member, and an elastic member that biases the movable body elastically. At a time that compressed air is supplied to the second flow passage, when a force that acts on the piston section based on the pressure of a first flow passage becomes smaller than a biasing force of the elastic member, due to the biasing force of the elastic member, the movable body is moved to a valve-closed position for blocking the second flow passage.

7 Claims, 8 Drawing Sheets

FLOW PASSAGE UNIT AND SWITCHING VALVE

CROSS-REFERENCE TO RELATED APPLICATION

This application is based upon and claims the benefit of priority from Japanese Patent Application No. 2015-095523 filed on May 8, 2015, the contents of which are incorporated herein by reference.

BACKGROUND OF THE INVENTION

Field of the Invention

The present invention relates to a flow passage unit and a switching valve, which are used in a pneumatic system equipped with an air cylinder.

Description of the Related Art

In an air cylinder, which is widely used as a pneumatic actuator in various types of automated machinery, a piston to which a rod is fixed is moved reciprocally by supply and discharge of compressed air in respective pressure chambers thereof. Additionally, in general, supply and discharge of compressed air with respect to this type of air cylinder is carried out through a switching valve.

Incidentally, in the aforementioned air cylinder, during a working stroke for performing work from among the reciprocating movements of the piston, since an external load is applied to the rod, a large driving force is required. In contrast thereto, during a return stroke when the piston is returned to its original position, since the aforementioned external load is not applied to the rod, the return stroke is completed with a smaller driving force than during the working stroke. The driving force depends on pressure level of the compressed air that is supplied to the pressure chambers. A savings in the amount of air consumption can be realized by reducing the pressure at the time of the return stroke.

Thus, to resolve the above-described problem, an energy-saving valve has been proposed by Japanese Laid-Open Patent Publication No. 2013-024345. The energy-saving valve is equipped with a main valve body in which a valve hole, an air supply port, a first output port, a second output port, and an exhaust port are formed, a single spool slidably inserted in the valve hole, and which connects the first output port and the second output port, respectively, to the air supply port or the exhaust port, a spool driving section that switches the spool from a first position to a second position, and a pressure regulating piston having a pressure receiving surface which is acted on by a pressure from the second output port, and on which an elastic biasing force is exerted. Corresponding to the pressure of the second output port, the spool is moved so as to change the cross-sectional area of a flow passage that passes from the air supply port to the second output port, whereby the spool sets the pressure of the second output port to a set pressure that is smaller than the pressure of the compressed air supplied from the air supply port.

SUMMARY OF THE INVENTION

The present invention has been devised in relation to the conventional technique described above, and has the object of providing a flow passage unit and a switching valve, which are capable of suppressing running costs and initial costs owing to a savings in air consumption, and with a simple structure, are superior in terms of usability.

For achieving the above object, according to the present invention, a flow passage unit is provided, which is used in a pneumatic system equipped with an air cylinder, the air cylinder being configured to perform a working stroke of a piston by introduction of compressed air into a first pressure chamber, and perform a return stroke of the piston by introduction of the compressed air into a second pressure chamber, the flow passage unit including a flow passage body including a first flow passage connected to the first pressure chamber, and a second flow passage connected to the second pressure chamber, and an energy-saving valve mechanism provided in the second flow passage in the interior of the flow passage body, the energy-saving valve mechanism being configured to switch between opening and blocking of the second flow passage, wherein the energy-saving valve mechanism includes a movable body including a piston section and a valve member, the piston section being configured to receive a pressure of the first flow passage, the valve member being configured to move integrally with the piston section, and an elastic member configured to bias the movable body elastically in a direction to block the second flow passage. In this case, at a time that compressed air is supplied to the second flow passage, when a force that acts on the piston section based on the pressure of the first flow passage becomes greater than a biasing force of the elastic member, the movable body moves to a valve-open position for opening the second flow passage in opposition to the biasing force of the elastic member, whereas when the force that acts on the piston section based on the pressure of the first flow passage becomes less than the biasing force of the elastic member, due to the biasing force of the elastic member, the movable body moves to a valve-closed position for blocking the second flow passage.

According to the flow passage unit, which is constructed as described above, during the return stroke of the air cylinder, when the piston reaches the stroke end, since the second flow passage is blocked by the energy-saving valve mechanism, any unnecessary introduction of compressed air into the second pressure chamber of the air cylinder is blocked, and a rise in pressure of the second pressure chamber is stopped. Consequently, due to a savings in air consumption at the time of the return stroke, running costs can be suppressed. Further, since the flow passage unit can be stacked below the switching valve, a convenience is realized in that subsequent addition of components is facilitated, and further, modifications are possible, for example, in the case that the working stroke side and the return stroke side of the air cylinder are to be reversed.

In the above-described flow passage unit, when the compressed air is supplied to the first flow passage, due to the pressure of the first flow passage acting on the piston section, the movable body may be moved to the valve-closed position in opposition to the biasing force of the elastic member.

Owing to this structure, since the pressure of the compressed air is utilized as a pilot pressure for operating the movable body to the valve-open position, the second flow passage is automatically placed in an open state when compressed air is supplied to the first flow passage in order to carry out the working stroke in the air cylinder. Consequently, exhaust air froth the air cylinder is allowed to flow through the second flow passage, and the working stroke of the air cylinder can be performed without any problems.

In the above-described flow passage unit, the flow passage body may include a slide hole in which the movable body is slidably arranged, and the slide hole may be partitioned by the piston section into the first flow passage and the second flow passage.

In accordance with this configuration, a mechanism by which the pressure of the first flow passage is made to act on the movable body can be realized with a simple structure.

In the above-described flow passage unit, a packing may be mounted on an outer circumferential part of the piston section, and wear rings may be mounted on respective both sides of the packing.

In the above-described flow passage unit, there may further be provided a safety valve mechanism configured to block the first flow passage at a time that the compressed air is not supplied to the first flow passage or the second flow passage. In this case, the safety valve mechanism may include a valve portion configured to move between a position for blocking the first flow passage and a position for opening the first flow passage, a biasing member configured to elastically bias the valve portion toward a valve-closed position, and a movable member including a piston section, and which is arranged movably in the interior of the flow passage body, wherein when the compressed air is supplied to the second flow passage, by receiving a pressure of the compressed air, the movable member moves the valve portion to a position to open the first flow passage.

Due to this structure, in the case that the supply pressure to the flow passage unit becomes zero during working of the air cylinder, the first flow passage is blocked through operation of the safety valve mechanism. Consequently, with a configuration in which the air cylinder is arranged with the piston rod thereof oriented downwardly, in the case that the supply pressure has become zero after the second flow passage has been blocked, since the air is blocked, it is possible to prevent falling of the air cylinder. Additionally, by providing the safety valve mechanism, in the case that the air cylinder is arranged with the piston rod thereof oriented upwardly for raising the workpiece, even when the supply pressure is reduced to zero, falling of the air cylinder (more specifically, falling of the piston and the piston rod thereof) can be prevented.

In the above-described flow passage unit, the flow passage body may include a first accommodating chamber in which the piston section of the safety valve mechanism is housed, a first communication passage configured to provide communication between the second flow passage and the first accommodating chamber, a second accommodating chamber in which the piston section of the energy-saving valve mechanism is housed, and a second communication passage configured to provide communication between the first flow passage and the second accommodating chamber.

In accordance with this configuration, the flow passage unit, which is equipped with the energy-saving valve mechanism operated by the pressure of the first flow passage, and the safety valve mechanism operated by the pressure of the second flow passage, can be realized with a simple structure.

Further, according to the present invention, a switching valve may be provided, which is used in a pneumatic system equipped with an air cylinder, the air cylinder being configured to perform a working stroke of a piston by introduction of compressed air into a first pressure chamber, and perform a return stroke of the piston by introduction of the compressed air into a second pressure chamber, the switching valve including a main valve unit including an air supply port to which compressed air is supplied from a pressure supply source, a first output port, a second output port, an exhaust port, and a spool configured to be slidable in an axial direction, wherein depending on a position of the spool in the axial direction, the main valve unit is operated in a state for placing the air supply port and the first output port in communication, and in a state for placing the air supply port and the second output port in communication, and a flow passage unit connected to the main valve unit. In this case, the flow passage unit may include a flow passage body including a first flow passage connected to the first pressure chamber, and a second flow passage connected to the second pressure chamber, the first flow passage communicating with the first output port, and the second flow passage communicating with the second output port, and an energy-saving valve mechanism provided in the second flow passage in the interior of the flow passage body, the energy-saving valve mechanism being configured to switch between opening and blocking of the second flow passage. Further, the energy-saving valve mechanism may include a movable body including a piston section and a valve member, the piston section being configured to receive a pressure of the first flow passage, the valve member being configured to move integrally with the piston section, and an elastic member configured to bias the movable body elastically in a direction to block the second flow passage. In this arrangement, at a time that compressed air is supplied to the second flow passage, when a force that acts on the piston section based on the pressure of the first flow passage becomes greater than a biasing force of the elastic member, the movable body moves to a valve-open position for opening the second flow passage in opposition to the biasing force of the elastic member, whereas when the force that acts on the piston section based on the pressure of the first flow passage becomes less than the biasing force of the elastic member, due to the biasing force of the elastic member, the movable body moves to a valve-closed position for blocking the second flow passage.

In accordance with the flow passage unit and the switching valve of the present invention, running costs and initial costs can be suppressed owing to a savings in air consumption, and with a simple structure, the flow passage unit and the switching valve are superior in terms of usability.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
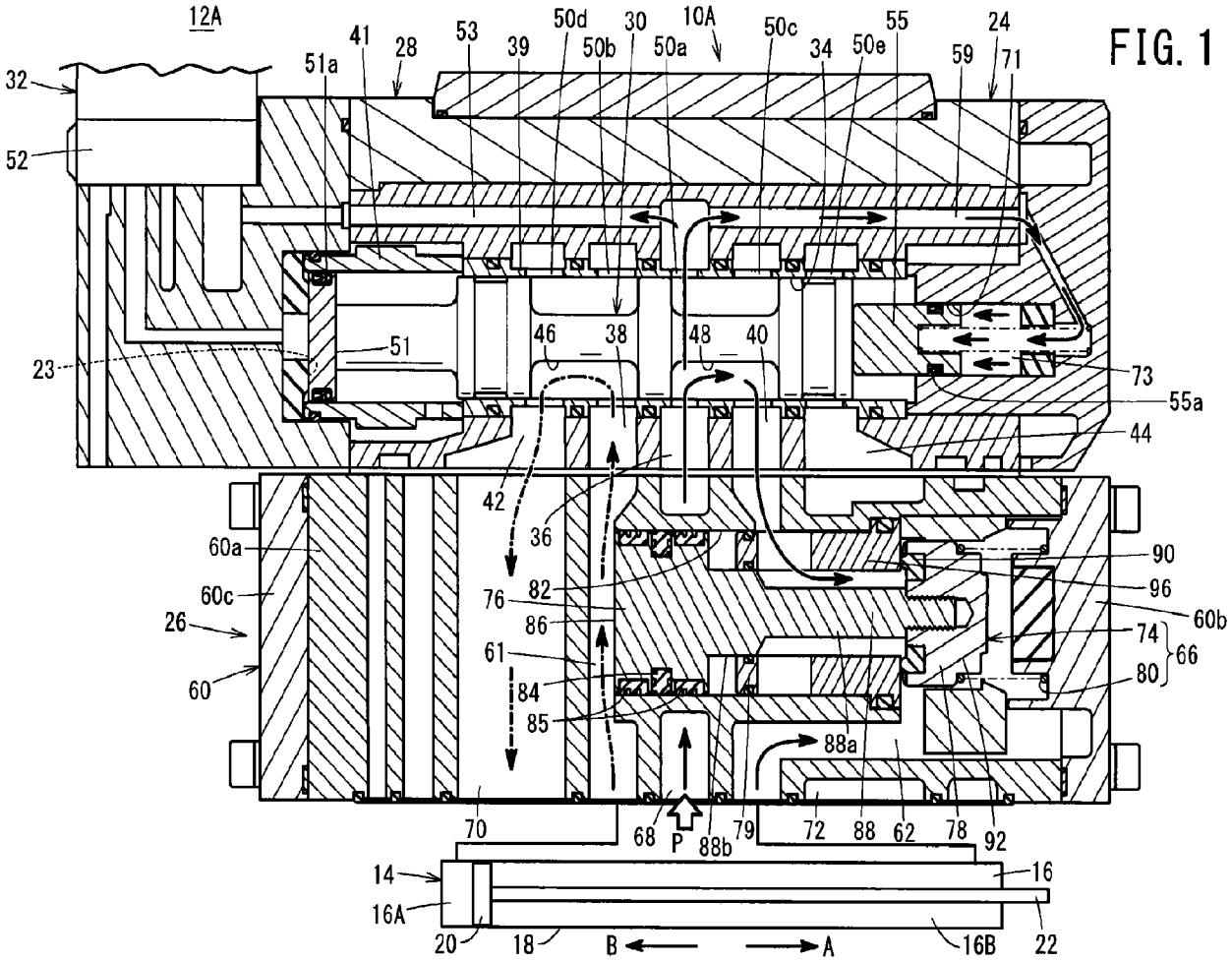
FIG. 1 is an outline schematic view (first explanatory drawing of operations) of a pneumatic system equipped with a switching valve according to a first embodiment of the present invention.

First and second preferred embodiments of a flow passage unit and a switching valve according to the present invention will be presented and described in detail below with reference to the accompanying drawings. In the second embodiment, constituent elements thereof, which offer the same functions and effects as those of the first embodiment, are denoted by the same reference characters, and detailed description of such features is omitted.

[First Embodiment]

A switching valve 10A according to a first embodiment of the present invention shown in FIG. 1 is used in a pneumatic system 12A equipped with an air cylinder 14. The air cylinder 14 includes a cylinder tube 18 in which a piston chamber 16 is formed, a piston 20 which is arranged for slidable reciprocal movement in the interior of the cylinder tube 18, and a piston rod 22 connected to the piston 20.

By the piston 20, the piston chamber 16 is partitioned into a first pressure chamber 16A and a second pressure chamber 16B. In the air cylinder 14, by compressed air being supplied to the first pressure chamber 16A, a working stroke is performed for effecting work, and by compressed air being supplied to the second pressure chamber 16B, a return stroke is performed to return the piston 20 to its initial position.

The switching valve 10A comprises a main valve unit 24 for switching between supply and discharge of compressed air from a non-illustrated pressure supply source (an air compressor or the like) with respect to the air cylinder 14, and a flow passage unit 26 connected to the main valve unit 24.

The main valve unit 24 includes a valve body 28, a spool 30 arranged to be slidable reciprocally in axial directions inside the valve body 28, and a solenoid valve 52 that drives a drive piston 51 in conjunction with the spool 30. In the valve body 28, there are formed a valve hole 34, an air supply port 36, a first output port 38, a second output port 40, a first exhaust port 42, and a second exhaust port 44. The spool 30 is inserted in the valve hole 34.

The valve hole 34 is formed to penetrate in the axial direction through the valve body 28, and the spool 30 is arranged so as to be slidable reciprocally in the interior of the valve hole 34. In the case of the present embodiment, the valve hole 34 is constituted by a hollow portion of a hollow cylindrical guide sleeve 39, which is disposed in a fixed manner in the interior of the valve body 28.

In the aforementioned guide sleeve 39, side holes 50*a* to 50*e* are provided corresponding respectively to the air supply port 36, the first output port 38, the second output port 40, the first exhaust port 42, and the second exhaust port 44. The air supply port 36, the first output port 38, the second output port 40, the first exhaust port 42, and the second exhaust port 44 communicate with the valve hole 34 through the respective side holes 50*a* to 50*e*.

In place of the first exhaust port 42 and the second exhaust port 44, which are provided separately, a single common exhaust port may be provided in the valve body 28.

Compressed air is supplied from the pressure supply source to the air supply port 36. Corresponding to the position of the spool 30, the first output port 38 is capable of communicating selectively with the air supply port 36 and the first exhaust port 42 through a recessed first annular flow path 46 provided on the spool 30. Corresponding to the position of the spool 30, the second output port 40 is capable of communicating selectively with the air supply port 36 and the second exhaust port 44 through a recessed second annular flow path 48 provided on the spool 30. The first annular flow path 46 and the second annular flow path 48 are disposed at different locations on the spool 30 in the axial direction.

Depending on the position of the spool 30 in the axial direction, the main valve unit 24 is operated between a first switched state in which the air supply port 36 and the first output port 38 are placed in communication together with the second output port 40 and the second exhaust port 44 being placed in communication (FIG. 2), and a second switched state in which the air supply port 36 and the second output port 40 are placed in communication together with the first output port 38 and the first exhaust port 42 being placed in communication (FIG. 1). In the first switched state, the air supply port 36 and the second output port 40 are not placed in communication. In the second switched state, the air supply port 36 and the first output port 38 are not placed in communication. Hereinafter, the axial position of the spool 30 in the first switched state will be referred to as a "first position", and the axial position of the spool 30 in the second switched state will be referred to as a "second position".

In the illustrated example, the air supply port 36, the first output port 38, the second output port 40, the first exhaust port 42, and the second exhaust port 44 are disposed on the same side in the valve body 28. In a modification, the air supply port 36, the first output port 38, the second output port 40, the first exhaust port 42, and the second exhaust port 44 may be disposed in a distributed manner on one side and another side in the valve body 28. For example, the first output port 38 and the second output port 40 may be disposed on one side in the valve body 28, whereas the air supply port 36, the first exhaust port 42, and the second exhaust port 44 may be disposed on another side in the valve body 28.

The drive piston 51, which is arranged slidably along the axial direction of the spool 30, is disposed so as to be slidable in the interior of a tubular member 41 that is provided in the interior of the valve body 28, and a packing 51*a* is mounted on an outer circumferential surface thereof.

The solenoid valve 52 is constituted so as to cause a pressure (supply pressure P) of the compressed air that is supplied from the air supply port 36 to act on a surface of the drive piston 51 on a side opposite from the spool 30, to thereby drive the drive piston 51. A flow passage in the interior of the solenoid valve 52 communicates with the air supply port 36 through a communication passage 53 that is formed in the valve body 28. The solenoid valve 52 is switched such that when it is turned on by supply of current thereto, compressed air is allowed to flow into a pressure acting chamber 23, and when it is turned off by canceling the supply of current thereto, the air in the interior of the pressure acting chamber 23 is discharged to the exterior.

Further, in the interior of the valve body 28, a return piston 55 is arranged that acts on the spool 30 to apply a force in the B direction based on the pressure (supply pressure P) of the air supply port 36. The return piston 55 is arranged slidably in the axial direction of the spool 30 in the interior of a slide hole 71 that is formed in the valve body 28. A packing 55*a* is installed on an outer circumferential part of the return piston 55. Due to the slide hole 71 being closed by the return piston 55, a pressure acting chamber 73 is formed in the interior of the slide hole 71.

A communication passage 59 providing communication between the air supply port 36 and the pressure acting chamber 73 is formed in the valve body 28. The pressure of the air supply port 36 acts on the pressure receiving surface of the return piston 55 through the communication passage 59. Consequently, the return piston 55 biases the spool 30 in the B direction based on the pressure of the air supply port 36. The pressure receiving area of the aforementioned drive piston 51 is greater than the pressure receiving area of the return piston 55.

The flow passage unit 26 includes a flow passage body 60, in which there are formed a first flow passage 61 in communication with the first output port 38 and a second flow passage 62 in communication with the second output port 40, and an energy-saving valve mechanism 66 provided in the second flow passage 62 in the interior of the flow passage body 60.

The flow passage body 60 is formed by assembling plural body elements together. In the case of the present embodiment, the flow passage body 60 includes a main flow passage member 60*a*, and end plates 60*b*, 60*c*, which are arranged on both sides of the main flow passage member 60*a*.

In the flow passage body 60, there are further formed an introduction passage 68 that communicates with the air supply port 36 of the main valve unit 24 and through which compressed air from the pressure supply source is introduced, a first exhaust passage 70 that communicates with the first exhaust port 42 and through which exhaust air from the first pressure chamber 16A flows, and a second exhaust passage 72 through which exhaust air from the second pressure chamber 16B flows.

The first flow passage 61 is a flow passage in fluid connection with the first pressure chamber 16A of the air cylinder 14, such that when the main valve unit 24 is operated in the aforementioned first switched state (FIG. 2), compressed air from the pressure supply source is introduced through the first output port 38 of the main valve unit 24, and the compressed air is supplied to the first pressure chamber 16A of the air cylinder 14. Further, in the first flow passage 61, when the main valve unit 24 is operated in the aforementioned second switched state (FIG. 1), exhaust air from the first pressure chamber 16A of the air cylinder 14 is introduced, and the exhaust air is guided to the first output port 38 of the main valve unit 24.

The second flow passage 62 is a flow passage in fluid connection with the second pressure chamber 16B of the air cylinder 14, such that when the main valve unit 24 is operated in the aforementioned first switched state, exhaust air from the second pressure chamber 16B of the air cylinder 14 is introduced, and the exhaust air is guided to the second output port 40 of the main valve unit 24. Further, in the second flow passage 62, when the main valve unit 24 is operated in the aforementioned second switched state, compressed air from the pressure supply source is guided through the second output port 40 of the main valve unit 24, and the compressed air is supplied to the second pressure chamber 16B of the air cylinder 14.

The energy-saving valve mechanism 66 is equipped with a movable body 74 including a piston section 76 and a valve member 78, and an elastic member 80 (a coil spring in the illustrated example) that biases the movable body 74 elastically in a direction to block the second flow passage 62. The movable body 74 is arranged to be capable of sliding reciprocally in a slide hole 82 that is formed in the flow passage body 60, and a ring shaped packing 84 is installed on an outer circumferential part of the piston section 76 of the movable body 74.

The outer circumferential surface of the packing 84 is held in close contact along the entire circumference on an inner circumferential surface that forms the slide hole 82, and a hermetic seal is formed thereby. The slide hole 82 is partitioned by the piston section 76 into the first flow passage 61 and the second flow passage 62 in a hermetical manner. The piston section 76 includes a pressure receiving surface 86 that receives the pressure of the first flow passage 61. Further, on respective both sides (i.e., a pressure receiving surface 86 side and a rod section 88 side) of the packing 84, wear rings 85, which are constituted for example from a hard resin, are installed on an outer circumferential part of the piston section 76.

The rod section 88, which is narrower than the piston section 76, extends from a side of the piston section 76 opposite to the pressure receiving surface 86 thereof. The rod section 88 includes a small diameter portion 88*a* and a large diameter portion 88*b*. In the slide hole 82, more on the side of the valve member 78 than on the piston section 76 side, a ring shaped partitioning member 79 is installed, in which seal members (o-rings) are mounted on inner and outer circumferential portions thereof. The seal member on the outer circumferential side of the partitioning member 79 is held in close contact with the inner circumferential surface of the slide hole 82, and the seal member on the inner circumferential side of the partitioning member 79 is held in close contact with the large diameter portion 88*b* of the rod section 88. As a result, the pressure of the second flow passage 62 does not act on the piston section 76. The valve member 78 is connected in a fixed manner to the extending end of the rod section 88.

The valve member 78 includes an annular packing 90 made up from an elastic body such as, for example, a rubber material or an elastomeric material or the like, and a packing holder 92 that retains the packing 90. In the interior of the flow passage body 60, a seat member 96 is disposed face-to-face with the packing 90. In a state in which the packing 90 is seated on the seat member 96, the second flow passage 62 is blocked. In a state in which the packing 90 is separated away from the seat member 96, the second flow passage 62 is opened.

In the present embodiment, the elastic member 80 is arranged on an opposite side from the movable body 74 with reference to the valve member 78, and elastically biases the valve member 78 toward the side of the movable body 74. When the first flow passage 61 is at atmospheric pressure, the valve member 78 is pressed against the seat member 96 due to the biasing force of the elastic member 80. When a moving force for moving the movable body 74 in the A direction based on the pressure of the first flow passage 61 acting on the pressure receiving surface 86, becomes greater than the biasing force (elastic force) of the elastic member 80, the movable body 74 is moved in the A direction in opposition to the biasing force of the elastic member 80. Consequently, the valve member 78 (packing 90) separates away from the seat member 96, and the second flow passage 62 is opened. When the moving force for moving the movable body 74 in the A direction based on the pressure of the first flow passage 61 acting on the pressure receiving surface 86, becomes smaller than the biasing force (elastic force) of the elastic member 80, the movable body 74 is moved in the B direction by the biasing force of the elastic member 80. Consequently, the valve member 78 (packing 90) is seated on the seat member 96, and the second flow passage 62 is blocked again.

Next, operations and effects of the switching valve 10A equipped with the flow passage unit 26, which is constructed as described above, will be described.

In FIG. 1, although compressed air from the pressure supply source is being supplied to the air supply port 36, the solenoid valve 52 is in an off state, and the spool 30 of the main valve unit 24 is positioned at the second position, and the movable body 74 is positioned at a closed position under the action of the biasing force of the elastic member 80. Further, the piston 20 of the air cylinder 14 is positioned in an initial position (a stroke end on the return side), and is retained in a state with a small amount of air pressure still remaining in the second pressure chamber 16B.

Figure 2:
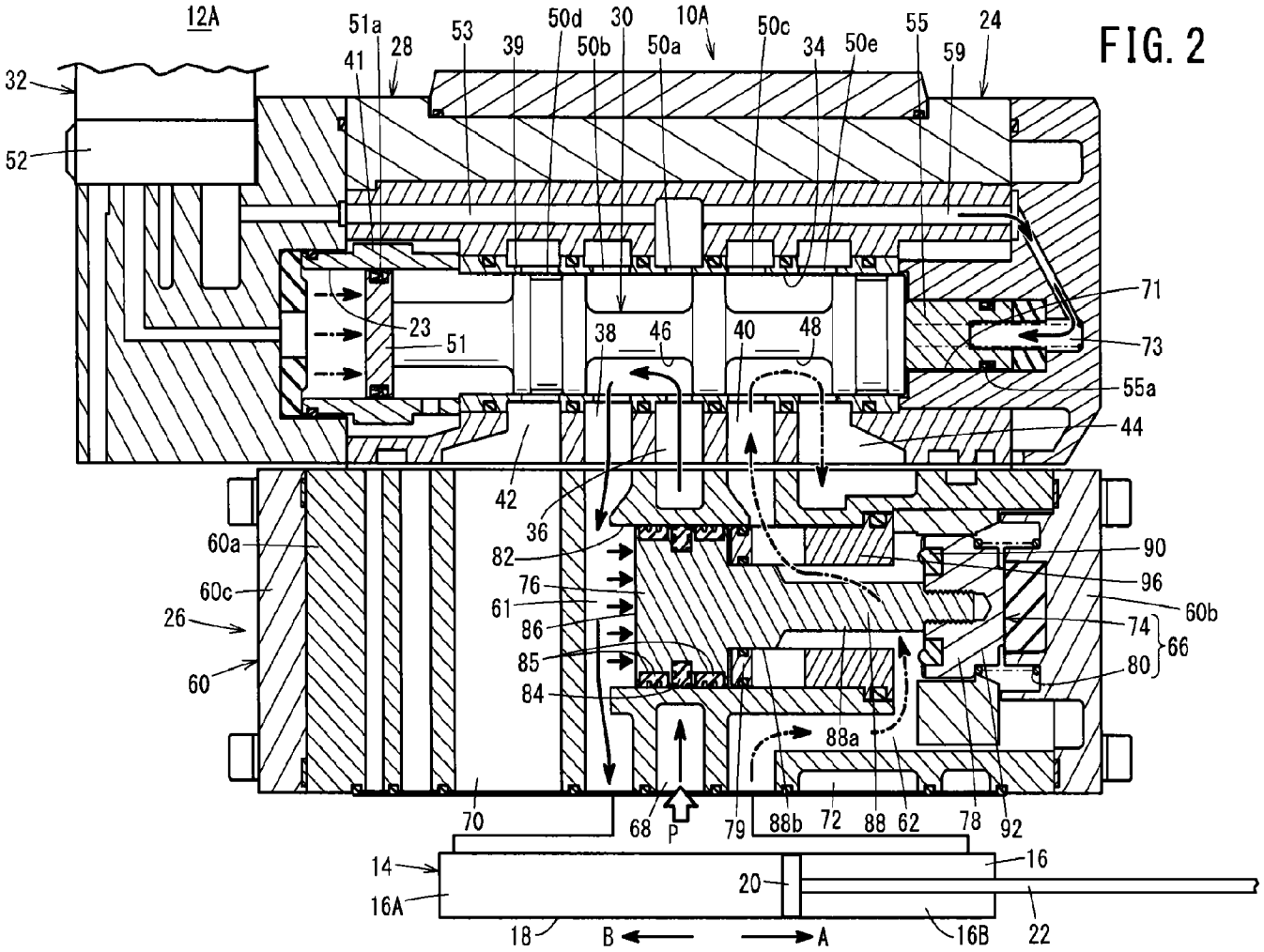
FIG. 2 is a second explanatory drawing of operations of the pneumatic system shown in FIG. 1.

From the condition shown in FIG. 1, when the solenoid valve 52 is placed in an on state, a pressure (supply pressure P) of the compressed air supplied to the air supply port 36 is exerted on the pressure receiving surface of the drive piston 51, whereby the spool 30 is pressed in the A direction by the drive piston 51. As a result, as shown in FIG. 2, the spool 30 is moved to a position at which the air supply port 36 and the first output port 38 are placed in communication, and the second output port 40 and the second exhaust port 44 are placed in communication.

Moreover, in this case, although the supply pressure P also is exerted on the return piston 55 through the communication passage 59, since the pressure receiving area of the drive piston 51 is greater than the pressure receiving area of the return piston 55, the force with which the drive piston 51 presses the spool 30 in the A direction is greater than the force with which the return piston 55 presses the spool 30 in the B direction. Consequently, the drive piston 51 can cause the spool 30 to be moved in the A direction as described above, in opposition to the pressing force of the return piston 55 in the B direction.

Accompanying movement of the spool 30 in this manner, the compressed air that is supplied to the air supply port 36 is introduced into the first pressure chamber 16A of the air cylinder 14 through the first output port 38 and the first flow passage 61 of the flow passage body 60. Further, at this time, by the pressure (supply pressure P) of the compressed air that flows in the first flow passage 61 acting on the pressure receiving surface 86 of the piston section 76 of the movable body 74, the movable body 74 is moved toward the valve-open position in opposition to the biasing force of the elastic member 80, whereby the second flow passage 62 is opened.

Figure 3:
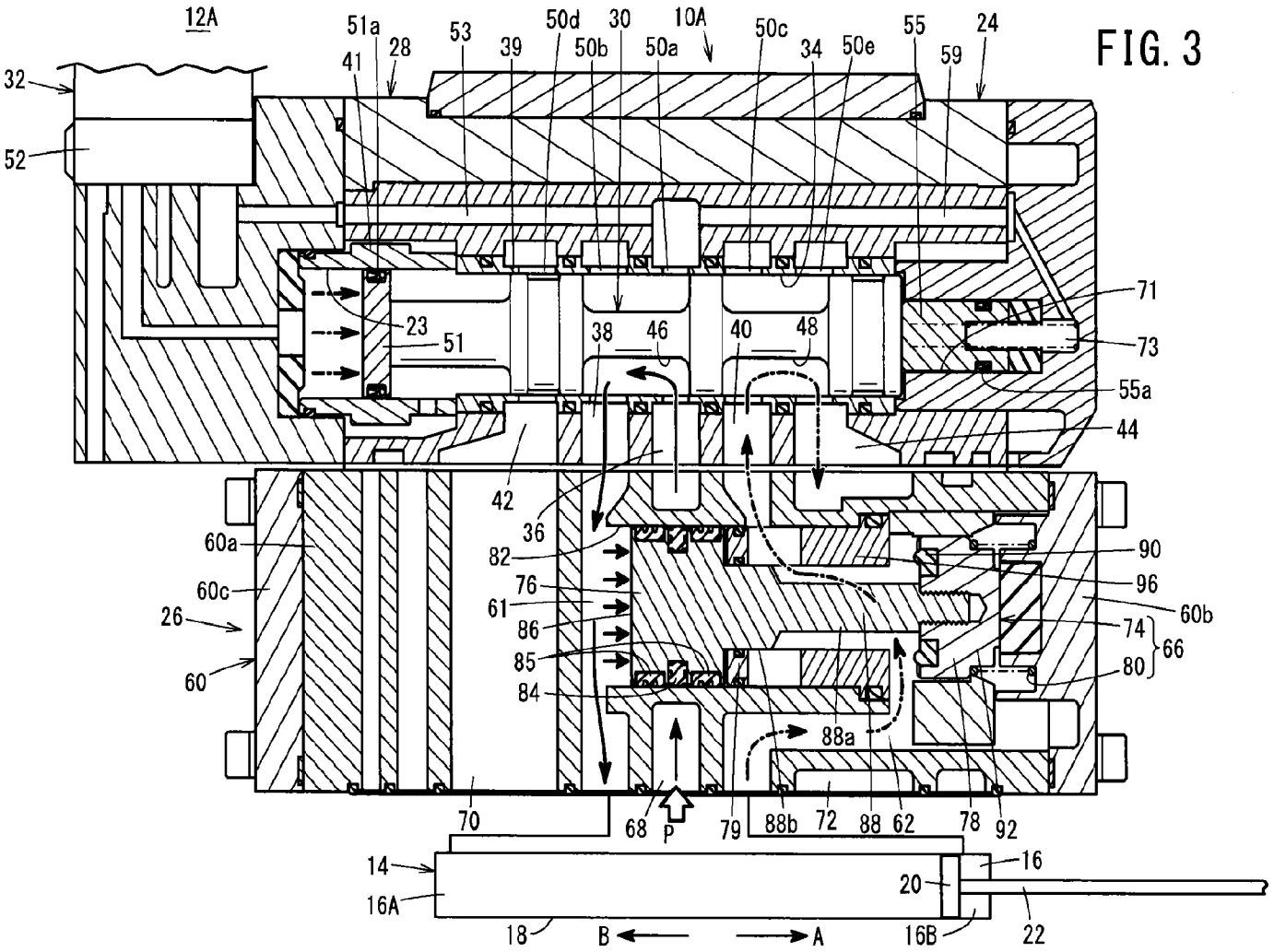
FIG. 3 is a third explanatory drawing of operations of the pneumatic system shown in FIG. 1.

Consequently, accompanying introduction of compressed air into the first pressure chamber 16A of the air cylinder 14, the air cylinder 14 performs a working stroke to advance the piston rod 22. At this time, since the second output port 40 and the second exhaust port 44 are in communication in the main valve unit 24, and the second flow passage 62 is opened in the flow passage unit 26, the air that has accumulated in the second pressure chamber 16B of the air cylinder 14 flows into the second output port 40 through the second flow passage 62, and further is exhausted to the exterior through the second exhaust port 44 and the second exhaust passage 72. Consequently, by the solenoid valve 52 being maintained in the on state, as shown in FIG. 3, the piston 20 of the air cylinder 14 is moved to the stroke end on the working side and stopped.

Figure 4:
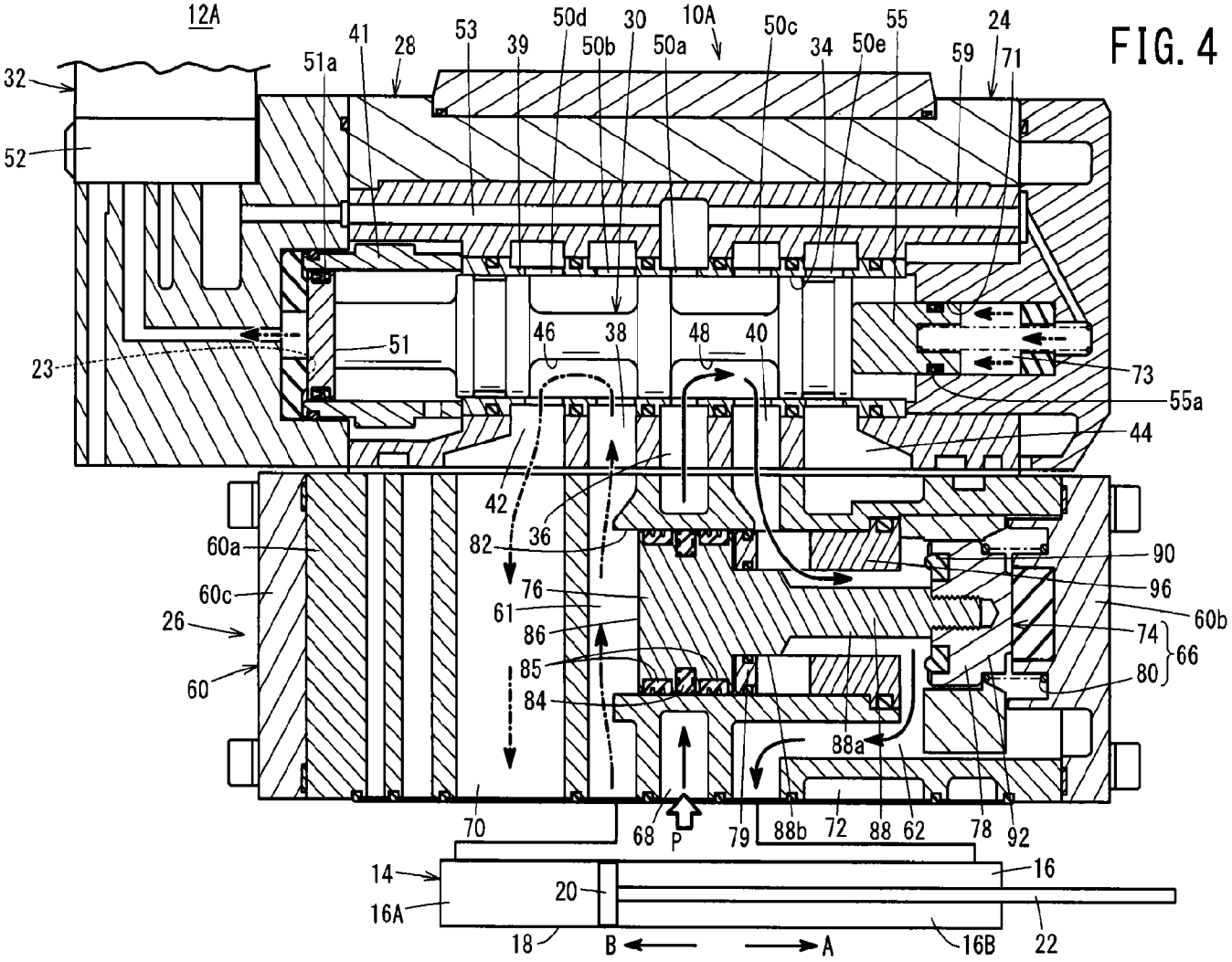
FIG. 4 is a fourth explanatory drawing of operations of the pneumatic system shown in FIG. 1.

Next, when the solenoid valve 52 is turned off while the supply of compressed air to the air supply port 36 is maintained, as shown in FIG. 4, accompanying movement of the spool 30 to the second position, the air supply port 36 and the second output port 40 are placed in communication, and the first output port 38 and the first exhaust port 42 are placed in communication. At this time, a force in the A direction that acts on the movable body 74 due to the pressure of the first flow passage 61 is still greater than the biasing force of the elastic member 80. Therefore, the movable body 74 is positioned in the valve-open position in opposition to the biasing force of the elastic member 80, whereby the opening of the second flow passage 62 is maintained.

Consequently, accompanying introduction of compressed air into the second pressure chamber 16B of the air cylinder 14, the air cylinder 14 performs a return stroke to retract the piston rod 22. At this time, the air that has accumulated in the first pressure chamber 16A of the air cylinder 14 flows into the first output port 38 through the first flow passage 61, and further is exhausted to the exterior through the first exhaust port 42 and the first exhaust passage 70.

In addition, accompanying the arrival of the piston 20 of the air cylinder 14 at the stroke end on the return side, the force acting on the movable body 74 due to the pressure of the first flow passage 61 becomes smaller than the biasing force of the elastic member, so that as shown in FIG. 1, the movable body 74 is moved to the valve-closed position under the biasing action of the elastic member 80. Consequently, the second flow passage 62 is blocked. In this manner, by blocking the second flow passage 62, supply of compressed air into the second pressure chamber 16B of the air cylinder 14 is blocked. Consequently, after the piston 20 of the air cylinder 14 has reached the stroke end on the return side, since unnecessary compressed air is not supplied to the second pressure chamber 16B of the air cylinder 14, air consumption can be reduced.

Further, in the condition shown in FIG. 1, since the second flow passage 62 is blocked, in the case of a configuration in which the air cylinder 14 is arranged with the piston rod 22 thereof oriented downwardly, even if the supply pressure P is stopped, unintentional falling of the air cylinder 14 (more specifically, the piston 20 and the piston rod 22 thereof) can be prevented.

As has been described above, in accordance with the switching valve 10A of the present embodiment, when the supply pressure P is applied to the second pressure chamber 16B of the air cylinder 14 in order to carry out the return stroke in the air cylinder 14, up until the piston 20 reaches a stroke end (return position/initial position) on the return side, since the pressure of the first flow passage 61 acts on the piston section 76 of the energy-saving valve mechanism 66, the second flow passage 62 remains open. Consequently, by applying the supply pressure P to the air cylinder 14 through the second flow passage 62, the return stroke of the air cylinder 14 can be performed without any problems.

In addition, accompanying the arrival of the piston 20 of the air cylinder 14 at the stroke end on the return side, when the force acting on the pressure receiving surface 86 of the piston section 76 due to the pressure of the first flow passage 61 becomes smaller than the biasing force of the elastic member 80, the movable body 74 is moved to the valve-closed position due to the biasing force of the elastic member 80, and the second flow passage 62 is blocked. As a result, any unnecessary introduction of compressed air into the second pressure chamber 16B of the air cylinder 14 is blocked, and a rise in pressure of the second pressure chamber 16B is stopped. Consequently, at the time of the return stroke, due to a savings in air consumption, running costs can be suppressed.

Further, as described above, since unnecessary introduction of compressed air into the second pressure chamber 16B of the air cylinder 14 is blocked, the interior of the second pressure chamber 16B is not increased in pressure any more than necessary. Consequently, during the working stroke of the next cycle, resistance to movement due to the pressure of the second pressure chamber 16B is reduced, and as a result, an increase in the speed of the working stroke can be expected.

The flow passage unit 26 of the present invention is of a simple structure, and can be used in combination with a conventional solenoid valve unit (flow passage switching valve) such as the main valve unit 24. Further, if the flow passage unit 26 is attachable and detachable with respect to the main valve unit 24, by installing the same as needed, a degree of freedom of use thereof is increased. For example, in the case that energy conservation problems occur after having connected the solenoid valve unit to the air cylinder 14, as a countermeasure thereto, such problems can be resolved by attaching the flow passage unit 26.

In the case of the present embodiment, since the pressure of the compressed air is utilized as a pilot pressure for operating the movable body 74 to the valve-open position, the second flow passage 62 is automatically placed in an open state when compressed air is supplied to the first flow passage 61 in order to carry out the working stroke in the air cylinder 14. Consequently, exhaust air from the air cylinder 14 is allowed to flow through the second flow passage 62, and the working stroke of the air cylinder 14 can be performed without any problems.

Furthermore, in the case of the present embodiment, the flow passage body 60 includes the slide hole 82 in which the movable body 74 is slidably arranged, and the slide hole 82 is partitioned by the piston section 76 into the first flow passage 61 and the second flow passage 62. In accordance with this configuration, a mechanism by which the pressure of the first flow passage 61 is made to act on the movable body 74 can be realized with a simple structure.

According to the present embodiment, the flow passage unit 26 has been described as being of a structure that is connected to the main valve unit 24. However, in a modification, a configuration may be provided in which the main valve unit 24 and the flow passage unit 26 are constructed integrally in an inseparable manner.

[Second Embodiment]

Figure 5:
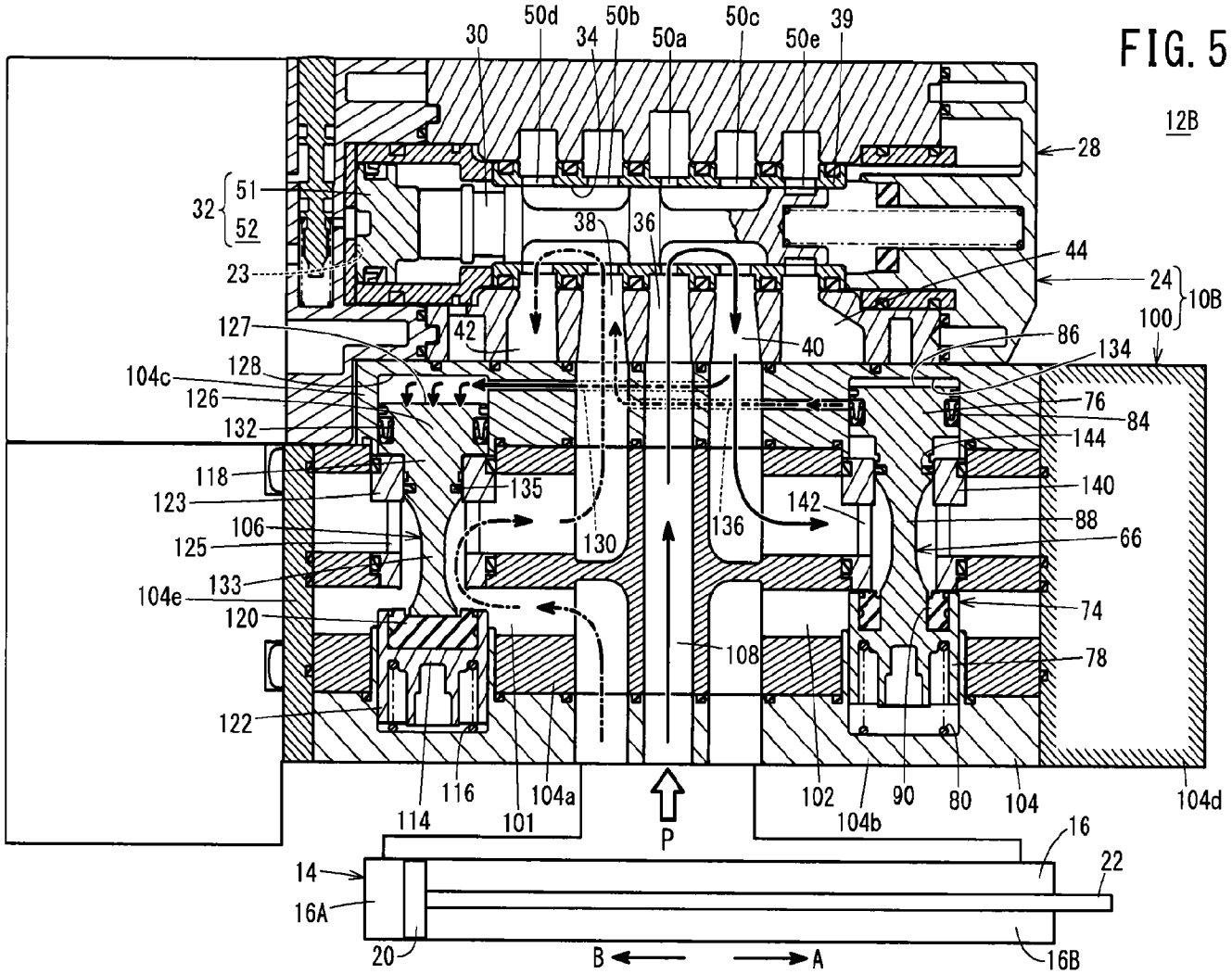
FIG. 5 is an outline schematic view (first explanatory drawing of operations) of a pneumatic system equipped with a switching valve according to a second embodiment of the present invention.

A switching valve 10B according to a second embodiment of the present invention, as shown in FIG. 5, is used in a pneumatic system 12B equipped with an air cylinder 14. In the present embodiment, the air cylinder 14 is arranged with the piston rod 22 oriented upwardly, such that during the working stroke, the piston 20 and the piston rod 22 are raised, and during the return stroke, the piston 20 and the piston rod 22 are lowered.

The switching valve 10B comprises a main valve unit 24 for switching between supply and discharge of compressed air from a pressure supply source (an air compressor or the like) with respect to the air cylinder 14, and a flow passage unit 100 connected to the main valve unit 24.

The flow passage unit 100 includes a flow passage body 104, in which there are formed a first flow passage 101 in communication with the first output port 38 and a second flow passage 102 in communication with the second output port 40, a safety valve mechanism 106 provided in the first flow passage 101 in the interior of the flow passage body 104, and an energy-saving valve mechanism 66 provided in the second flow passage 102 in the interior of the flow passage body 104.

The flow passage body 104 is a block shaped member in which plural body elements thereof (first through fifth members 104*a* to 104*e*) are assembled together. In the flow passage body 104, there is further formed an introduction passage 108 that communicates with the air supply port 36 of the main valve unit 24 and through which compressed air from the pressure supply source is introduced.

The first flow passage 101 is a flow passage in fluid connection with the first pressure chamber 16A of the air cylinder 14, such that when the main valve unit 24 is operated in the aforementioned first switched state (FIG. 6), compressed air from the pressure supply source is introduced through the first output port 38 of the main valve unit 24, and the compressed air is supplied to the first pressure chamber 16A of the air cylinder 14. Further, in the first flow passage 101, when the main valve unit 24 is operated in the aforementioned second switched state (FIGS. 5 and 8), exhaust air from the first pressure chamber 16A of the air cylinder 14 is introduced, and the exhaust air is guided to the first output port 38 of the main valve unit 24.

The second flow passage 102 is a flow passage in fluid connection with the second pressure chamber 16B of the air cylinder 14, such that when the main valve unit 24 is operated in the aforementioned first switched state, air that has accumulated in the second pressure chamber 16B of the air cylinder 14 is introduced, and such air is guided to the second output port 40 of the main valve unit 24. Further, in the second flow passage 102, when the main valve unit 24 is operated in the aforementioned second switched state (FIG. 8), compressed air from the pressure supply source is introduced through the second output port 40 of the main valve unit 24, and the compressed air is supplied to the second pressure chamber 16B of the air cylinder 14.

The safety valve mechanism 106 is constituted so as to block the first flow passage 101 when compressed air from the pressure supply source is not being supplied to the first flow passage 101 or the second flow passage 102. More specifically, the safety valve mechanism 106 includes a valve portion 114, a biasing member 116 (a coil spring in the illustrated embodiment), and a movable member 118.

Figure 6:
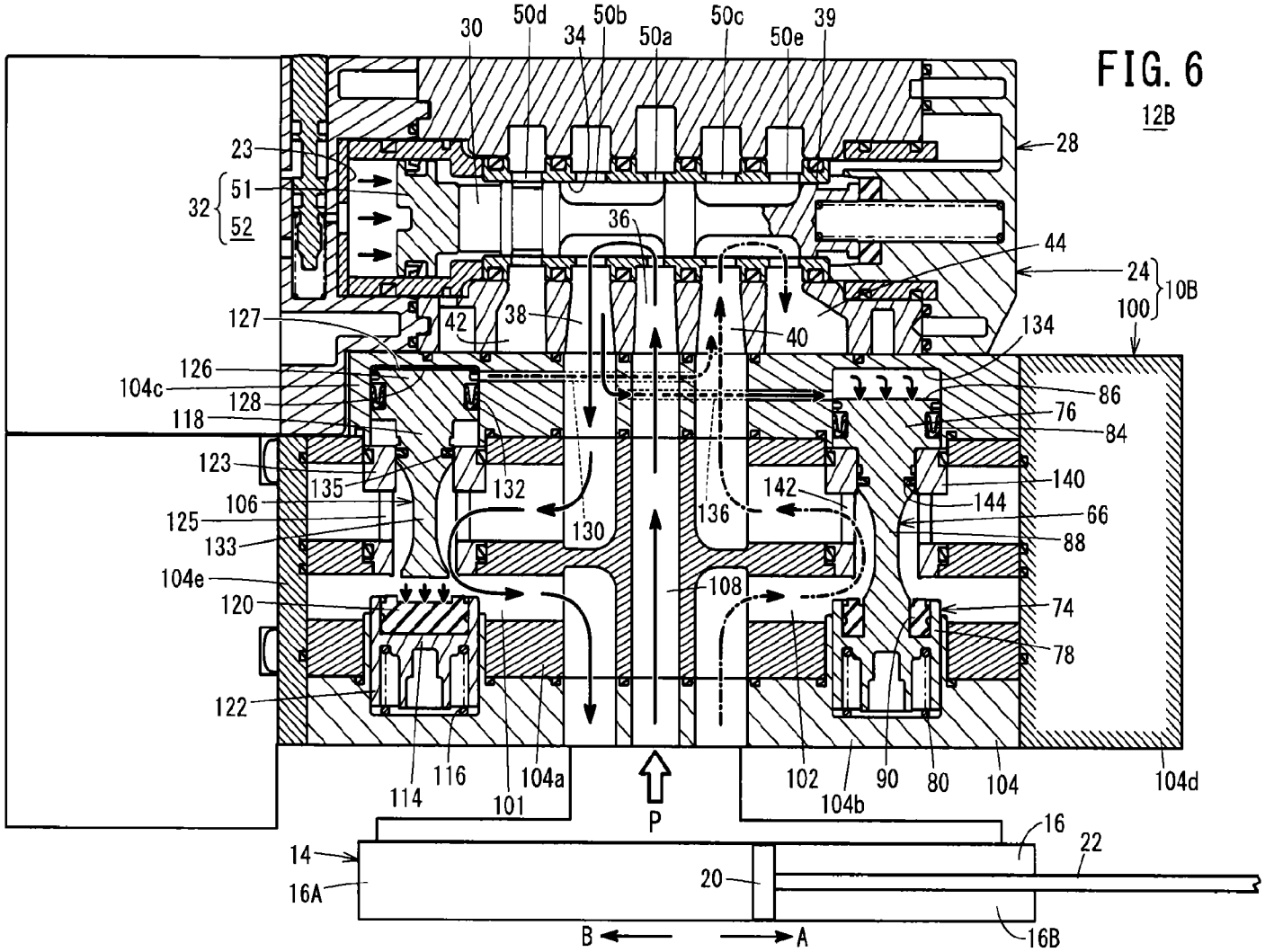
FIG. 6 is a second explanatory drawing of operations of the pneumatic system shown in FIG. 5.
Figure 7:
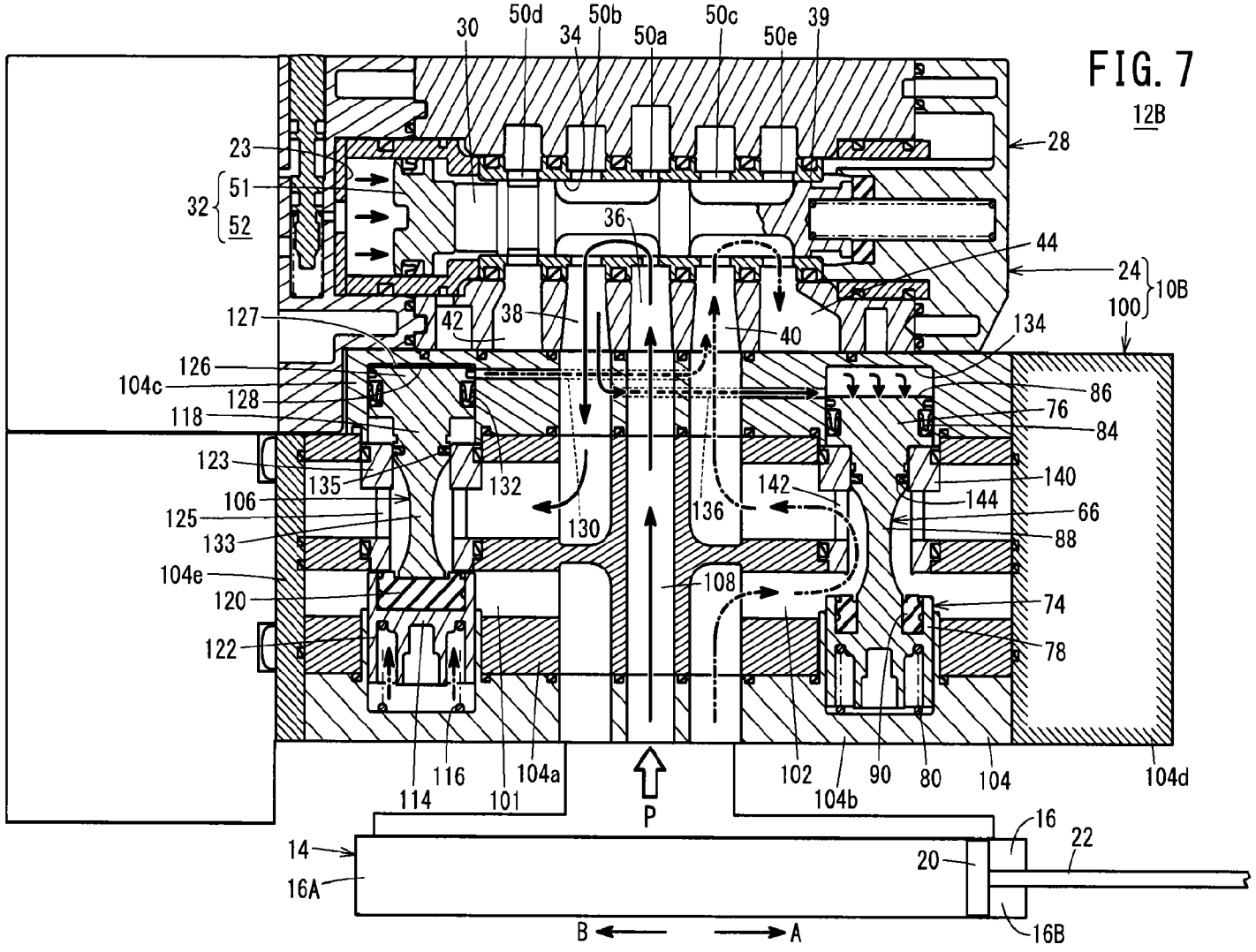
FIG. 7 is a third explanatory drawing of operations of the pneumatic system shown in FIG. 5.
Figure 8:
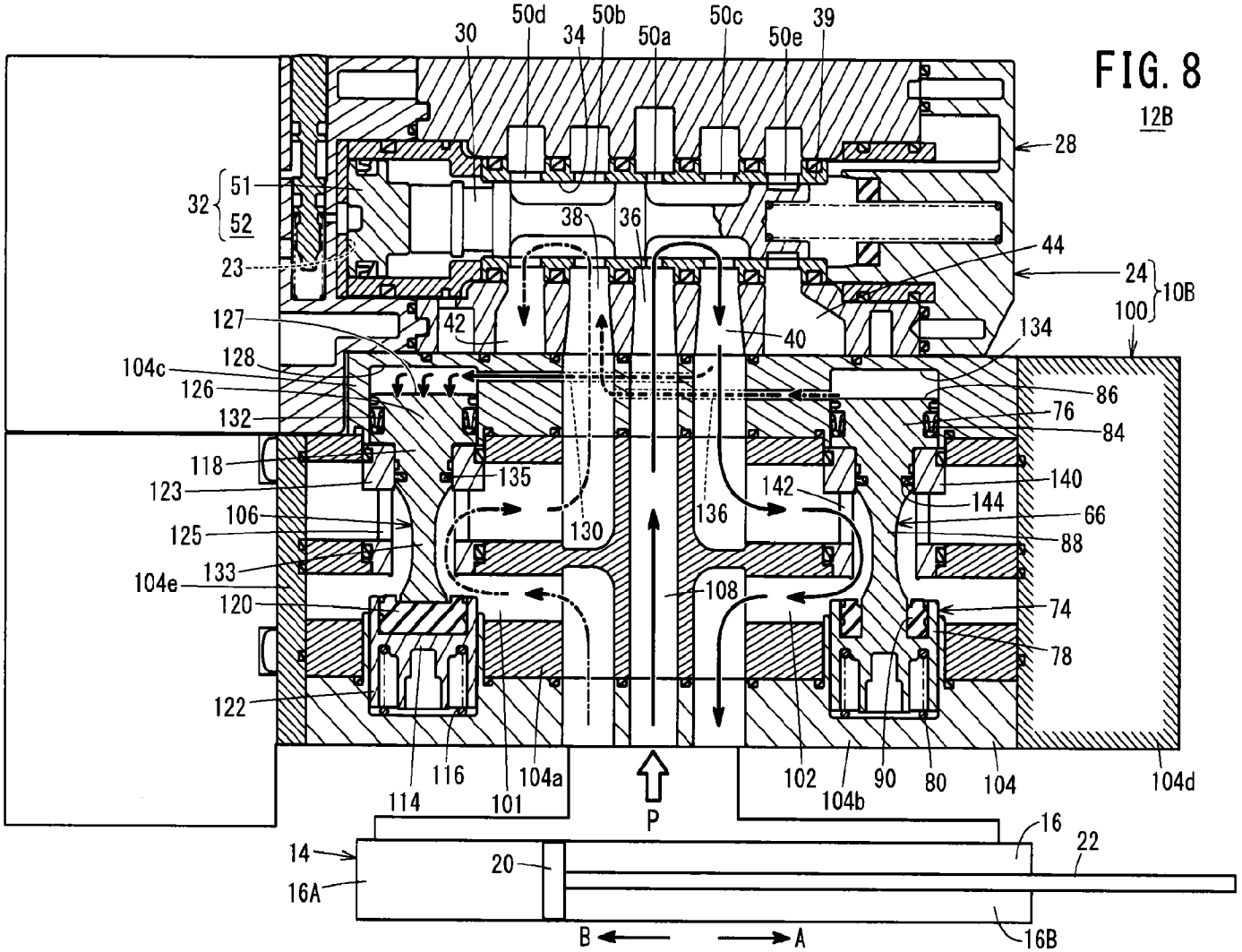
FIG. 8 is a fourth explanatory drawing of operations of the pneumatic system shown in FIG. 5.

The valve portion 114 is arranged so as to be capable of moving between a position to block the first flow passage 101 (see FIG. 7), and a position to open the first flow passage 101 (see FIGS. 5, 6 and 8). The valve portion 114 is capable of moving along the axial direction (movable direction) of the movable member 118. According to the present embodiment, the valve portion 114 includes a disk shaped packing 120, and a packing holder 122 that retains the packing 120. The packing 120 may also be constructed in a ring shape.

In the interior of the flow passage body 104, there is arranged a tubular member 123 having a seat surface that is formed face-to-face with the packing 120. Plural side holes 125 are formed in the tubular member 123 with intervals therebetween in the circumferential direction. In a state in which the packing 120 is seated on the seat surface of the tubular member 123, the first flow passage 101 is blocked. In a state in which the packing 120 is separated away from the seat surface of the tubular member 123, the first flow passage 101 is opened.

The biasing member 116 biases the valve portion 114 elastically toward a valve-closed position. In the present embodiment, the biasing member 116 is arranged on an opposite side from the movable member 118 with respect to the valve portion 114, and elastically biases the valve portion 114 toward the side of the movable member 118.

The movable member 118 includes a piston section 126, and is arranged movably in the interior of the flow passage body 104. At a time that compressed air is supplied to the second flow passage 102, by the movable member 118 receiving the pressure of the compressed air, the valve portion 114 is moved to a position to open the first flow passage 101.

The movable member 118 is capable of moving along the axial direction. The piston section 126 includes a pressure receiving surface 127, and is accommodated slidably in the interior of a first accommodating chamber 128 that is formed in the interior of the flow passage body 104. The first accommodating chamber 128 communicates with the second flow passage 102 through a first communication passage 130 formed in the flow passage body 104.

A ring shaped first packing 132 is installed on an outer circumferential part of the piston section 126. The outer circumferential surface of the first packing 132 is held in close contact along the entire circumference on an inner circumferential surface of the first accommodating chamber 128, and a hermetic seal is formed thereby. A rod section 133 extends toward the side of the valve portion 114 from a side of the piston section 126 opposite to the pressure receiving surface 127 thereof. The rod section 133 is narrower than the piston section 126, and an extending end thereof (an end on a side opposite from the piston section 126) is capable of pressing the valve portion 114. A ring shaped second packing 135 is installed on an outer circumferential part of the rod section 133. The outer circumferential surface of the second packing 135 is held in close contact along the entire circumference on an inner circumferential surface of the tubular member 123, and a hermetic seal is formed thereby.

A biasing force (elastic force) of the biasing member 116 is smaller than the force by which the valve portion 114 is pressed toward the valve-open position by the pressure (supply pressure P) of the compressed air when the compressed air is introduced into the first flow passage 101 from the first output port 38. Further, the biasing force of the biasing member 116 is smaller than the force at which the movable member 118 presses the valve portion 114 toward the valve-open position by the pressure of the compressed air when the compressed air is introduced into the second flow passage 102 from the second output port 40. Consequently, when the compressed air is not introduced into the first flow passage 101, and when the compressed air is not introduced into the first accommodating chamber 128, due to the biasing force of the biasing member 116, the valve portion 114 is pressed against the tubular member 123, whereby the first flow passage 101 is blocked.

In the present embodiment, the energy-saving valve mechanism 66, similar to the energy-saving valve mechanism 66 shown in FIG. 1, is equipped with a movable body 74 including a piston section 76 and a valve member 78, and an elastic member 80 (a coil spring in the illustrated example) that biases the movable body 74 elastically in a direction to block the second flow passage 102. The piston section 76 is accommodated slidably in the interior of a second accommodating chamber 134 formed in the interior of the flow passage body 104. The second flow passage 102 and the second accommodating chamber 134 are separated hermetically by the piston section 76. The second accommodating chamber 134 communicates with the first flow passage 101 through a second communication passage 136 formed in the flow passage body 104.

A tubular member 140 is arranged in the interior of the flow passage body 104, and plural side holes 142 are formed in the tubular member 140 with intervals therebetween in the circumferential direction. A ring shaped packing 144 is installed on an outer circumferential part of the rod section 88. The outer circumferential surface of the packing 144 is held in close contact along the entire circumference on an inner circumferential surface of the tubular member 140, and a hermetic seal is formed thereby. When the force that acts on the piston section 76 by the pressure of the first flow passage 101 becomes smaller than the biasing force of the elastic member 80, a portion of the valve member 78 (packing 90) of the movable body 74 is pressed against the tubular member 140 by the biasing force of the elastic member 80, whereby the second flow passage 102 is blocked.

Next, operations and effects of the switching valve 10B equipped with the flow passage unit 100, which is constructed as described above, will be described.

In FIG. 5, although compressed air from the pressure supply source is being supplied to the air supply port 36, the solenoid valve 52 is in an off state, the spool 30 of the main valve unit 24 is positioned at the second position, the piston section 126 of the safety valve mechanism 106 receives the supply pressure P so that the valve portion 114 is positioned at a valve-open position, and the movable body 74 of the energy-saving valve mechanism 66 is positioned at a valve-closed position under the action of the biasing force of the elastic member 80. Further, the piston 20 of the air cylinder 14 is positioned in an initial position (a stroke end on the return side), and is retained in a state with a small amount of air pressure still remaining in the second pressure chamber 16B.

From the condition shown in FIG. 5, when the solenoid valve 52 is turned on, as shown in FIG. 6, accompanying movement of the spool 30 to the first position, the air supply port 36 and the first output port 38 are placed in communication, and by the pressure (supply pressure P) of the compressed air that is introduced into the first flow passage 101, the valve portion 114 is maintained in the valve-open state in opposition to the biasing force of the biasing member 116. Therefore, compressed air is introduced into the first pressure chamber 16A of the air cylinder 14 through the first output port 38 and the first flow passage 101. Further, at this time, by introduction of the compressed air into the second accommodating chamber 134 through the second communication passage 136, the supply pressure P acts on the pressure receiving surface 86 of the piston section 76 of the movable body 74. As a result, the movable body 74 moves toward the valve-open position in opposition to the biasing force of the elastic member 80, and the second flow passage 102 is opened.

Consequently, accompanying introduction of compressed air into the first pressure chamber 16A of the air cylinder 14, the air cylinder 14 performs a working stroke to advance (raise) the piston rod 22. At this time, since the second output port 40 and the second exhaust port 44 are in communication in the main valve unit 24, and the second flow passage 102 is opened in the flow passage unit 100, the air that has accumulated in the second pressure chamber 16B of the air cylinder 14 flows into the second output port 40 through the second flow passage 102, and further is exhausted to the exterior through the second exhaust port 44. Consequently, by the solenoid valve 52 being maintained in the on state, as shown in FIG. 7, the piston 20 of the air cylinder 14 is moved to the stroke end on the working side and stopped.

In the case that the supply pressure P to the switching valve 10B from the pressure supply source is reduced to zero due to some reason, accompanying the supply pressure P failing to act on the valve portion 114 of the safety valve mechanism 106, due to the biasing force of the biasing member 116, the valve portion 114 is moved to the valve-closed position and the first flow passage 101 is blocked. Consequently, discharging of air from the first pressure chamber 16A of the air cylinder 14 is obstructed, and unintentional falling of the piston 20 and the piston rod 22 is prevented.

After completion of the working stroke, when the solenoid valve 52 is turned off while the supply of compressed air to the air supply port 36 is maintained, as shown in FIG. 8, accompanying movement of the spool 30 to the second position, the air supply port 36 and the second output port 40 are placed in communication, and the first output port 38 and the first exhaust port 42 are placed in communication. At this time, by the supply pressure P acting on the pressure receiving surface 127 of the piston section 126 of the safety valve mechanism 106 through the first communication passage 130, the movable member 118 presses the valve portion 114 to the valve-open position in opposition to the biasing force of the biasing member 116, whereby the first flow passage 101 is opened. On the other hand, even after the spool 30 has been moved as described above, a force that acts on the pressure receiving surface of the movable body 74 is still greater than the biasing force of the elastic member 80. Therefore, the movable body 74 is positioned in the valve-open position in opposition to the biasing force of the elastic member 80, whereby the opening of the second flow passage 102 is maintained.

Consequently, accompanying introduction of compressed air into the second pressure chamber 16B of the air cylinder 14, the air cylinder 14 performs a return stroke to retract the piston rod 22. At this time, the air that has accumulated in the first pressure chamber 16A of the air cylinder 14 flows into the first output port 38 through the first flow passage 101, and further is exhausted to the exterior through the first exhaust port 42.

In addition, accompanying the arrival of the piston 20 of the air cylinder 14 at the stroke end on the return side, the force acting on the pressure receiving surface of the movable body 74 becomes smaller than the biasing force of the elastic member 80, so that as shown in FIG. 5, the movable body 74 is moved to the valve-closed position under the biasing action of the elastic member 80. Consequently, the second flow passage 102 is blocked. In this manner, by blocking the second flow passage 102, supply of compressed air into the second pressure chamber 16B of the air cylinder 14 is blocked. Consequently, after the piston 20 of the air cylinder 14 has reached the stroke end on the return side, since unnecessary compressed air is not supplied to the second pressure chamber 16B of the air cylinder 14, air consumption can be reduced.

As has been described above, in accordance with the switching valve 10B of the present embodiment, when the piston 20 reaches the stroke end during the return stroke of the air cylinder 14, since the second flow passage 102 is blocked by the energy-saving valve mechanism 66, any unnecessary introduction of compressed air into the second pressure chamber 16B of the air cylinder 14 is blocked, and a rise in pressure of the second pressure chamber 16B is stopped. Consequently, due to a savings in air consumption at the time of the return stroke, running costs can be suppressed.

With the aforementioned first embodiment (see FIGS. 1 to 4), the energy-saving valve mechanism 66 reduces the flow rate in the interior of the flow passage before the compressed air applied from the supply port of the introduction passage 68 is introduced into the main valve unit 24. In contrast thereto, with the second embodiment, the energy-saving valve mechanism 66, which is positioned apart from the introduction passage 108, does not reduce the flow rate in the interior of the flow passage before the compressed air applied from the supply port of the introduction passage 108 is introduced into the main valve unit 24.

According to the present embodiment, in the case that the supply pressure P to the flow passage unit 100 becomes zero during working of the air cylinder 14, the first flow passage 101 is blocked through operation of the safety valve mechanism 106. Consequently, in a configuration in which the air cylinder 14 is arranged with the piston rod 22 thereof oriented upwardly, even if the supply pressure P is reduced to zero, unintentional falling of the air cylinder 14 (more specifically, the piston 20 and the piston rod 22 thereof) can be prevented.

Furthermore, according to the present embodiment, the flow passage body 104 includes the first accommodating chamber 128 in which the piston section 126 of the safety valve mechanism 106 is housed, the first communication passage 130 that provides communication between the second flow passage 102 and the first accommodating chamber 128, the second accommodating chamber 134 in which the piston section 76 of the energy-saving valve mechanism 66 is housed, and the second communication passage 136 that provides communication between the first flow passage 101 and the second accommodating chamber 134. In accordance with this configuration, the flow passage unit 100, which is equipped with the energy-saving valve mechanism 66 operated by the pressure of the first flow passage 101, and the safety valve mechanism 106 operated by the pressure of the second flow passage 102, can be realized with a simple structure.

According to the present embodiment, although the flow passage unit has been described as being of a structure that is connected to the main valve unit, in a modification, a configuration may be provided in which the flow passage unit is incorporated in the main valve unit.

In the second embodiment, concerning the respective constituent elements thereof which are common with the first embodiment, it is a matter of course that the same or similar actions and effects as those possessed by the respective constituent elements in common with the first embodiment can be obtained.

Although preferred embodiments of the present invention have been presented and described above, the present invention is not limited to such embodiments, and it goes without saying that various additional or modified arrangements may be adopted therein without departing from the essential scope of the present invention as defined in the appended claims.

What is claimed is:

1. A flow passage unit, which is used in a pneumatic system equipped with an air cylinder, the air cylinder being configured to perform a working stroke of a piston by introduction of compressed air into a first pressure chamber, and perform a return stroke of the piston by introduction of the compressed air into a second pressure chamber, the flow passage unit comprising:

a flow passage body including a first flow passage connected to the first pressure chamber, and a second flow passage connected to the second pressure chamber; and an energy-saving valve mechanism provided in the second flow passage in an interior of the flow passage body, the energy-saving valve mechanism being configured to switch between opening and blocking of the second flow passage;

wherein the energy-saving valve mechanism includes:

a movable body including a piston section and a valve member, the piston section being configured to receive a pressure of the first flow passage, the valve member being configured to move integrally with the piston section; and an elastic member configured to bias the movable body elastically in a direction to block the second flow passage; and wherein, when a force that acts on the piston section based on the pressure of the first flow passage becomes greater than a biasing force of the elastic member, the movable body moves, due to the force acting on the piston section, to a valve-open position for opening the second flow passage in opposition to the biasing force of the elastic member, whereas when the force that acts on the piston section based on the pressure of the first flow passage becomes less than the biasing force of the elastic member, due to the biasing force of the elastic member, the movable body moves to a valve-closed position for blocking the second flow passage, and at all positions of the movable body, the movable body keeps the first flow passage open for either supply or exhaust to or from the first pressure chamber.

2. The flow passage unit according to claim 1, wherein when the compressed air is supplied to the first flow passage, due to a pressure of the compressed air acting on the piston section, the movable body moves to the valve open position in opposition to the biasing force of the elastic member.

3. The flow passage unit according to claim 1, wherein:

the flow passage body includes a slide hole in which the movable body is slidably arranged; and the slide hole is partitioned by the piston section into the first flow passage and the second flow passage.

4. The flow passage unit according to claim 3, wherein a packing is mounted on an outer circumferential part of the piston section, and wear rings are mounted on respective sides of the packing.

5. A flow passage unit, which is used in a pneumatic system equipped with an air cylinder, the air cylinder being configured to perform a working stroke of a piston by introduction of compressed air into a first pressure chamber, and perform a return stroke of the piston by introduction of the compressed air into a second pressure chamber, the flow passage unit comprising:

a flow passage body including a first flow passage connected to the first pressure chamber, and a second flow passage connected to the second pressure chamber; and an energy-saving valve mechanism provided in the second flow passage in an interior of the flow passage body, the energy-saving valve mechanism being configured to switch between opening and blocking of the second flow passage:

wherein the energy-saving valve mechanism includes:

a movable body including a piston section and a valve member, the piston section being configured to receive a pressure of the first flow passage, the valve member being configured to move integrally with the piston section; and an elastic member configured to bias the movable body elastically in a direction to block the second flow passage; and wherein, when a force that acts on the piston section based on the pressure of the first flow passage becomes greater than a biasing force of the elastic member, the movable body moves to a valve-open position for opening the second flow passage in opposition to the biasing force of the elastic member, whereas when the force that acts on the piston section based on the pressure of the first flow passage becomes less than the biasing force of the elastic member, due to the biasing force of the elastic member, the movable body moves to a valve-closed position for blocking the second flow passage, further comprising a safety valve mechanism configured to block the first flow passage at a time that the compressed air is not supplied to the first flow passage or the second flow passage;

wherein the safety valve mechanism comprises:

a valve portion configured to move between a position for blocking the first flow passage and a position for opening the first flow passage;

a biasing member configured to elastically bias the valve portion toward a valve-closed position; and a movable member including a piston section, and which is arranged movably in an interior of the flow passage body, wherein when the compressed air is supplied to the second flow passage, by receiving a pressure of the compressed air, the movable member moves the valve portion to a position to open the first flow passage.

6. The flow passage unit according to claim 5, wherein the flow passage body includes a first accommodating chamber in which the piston section of the safety valve mechanism is housed, a first communication passage configured to provide communication between the second flow passage and the first accommodating chamber, a second accommodating chamber in which the piston section of the energy-saving valve mechanism is housed, and a second communication passage configured to provide communication between the first flow passage and the second accommodating chamber.

7. A switching valve, which is used in a pneumatic system equipped with an air cylinder, the air cylinder being configured to perform a working stroke of a piston by introduction of compressed air into a first pressure chamber, and perform a return stroke of the piston by introduction of the compressed air into a second pressure chamber, the switching valve comprising:

a main valve unit including an air supply port to which compressed air is supplied from a pressure supply source, a first output port, a second output port, an exhaust port, and a spool configured to be slidable in an axial direction, wherein depending on a position of the spool in the axial direction, the main valve unit is operated in a state for placing the air supply port and the first output port in communication, and in a state for placing the air supply port and the second output port in communication; and a flow passage unit connected to the main valve unit, the flow passage unit comprising:

a flow passage body including a first flow passage connected to the first pressure chamber, and a second flow passage connected to the second pressure chamber, the first flow passage communicating with the first output port, and the second flow passage communicating with the second output port; and an energy-saving valve mechanism provided in the second flow passage in an interior of the flow passage body, the energy-saving valve mechanism being configured to switch between opening and blocking of the second flow passage;

wherein the energy-saving valve mechanism includes:

a movable body including a piston section and a valve member, the piston section being configured to receive a pressure of the first flow passage, the valve member being configured to move integrally with the piston section; and an elastic member configured to bias the movable body elastically in a direction to block the second flow passage; and wherein, when a force that acts on the piston section based on the pressure of the first flow passage becomes greater than a biasing force of the elastic member, the movable body moves to a valve-open position for opening the second flow passage in opposition to the biasing force of the elastic member, whereas when the force that acts on the piston section based on the pressure of the first flow passage becomes less than the biasing force of the elastic member, due to the biasing force of the elastic member, the movable body moves to a valve-closed position for blocking the second flow passage.

* * * * *